US007940010B2

(12) United States Patent
Patterson

(10) Patent No.: US 7,940,010 B2
(45) Date of Patent: May 10, 2011

(54) EMERGENCY LIGHTING

(76) Inventor: Kieran Patterson, Lurgan (GB)

( * ) Notice: Subject to any disclaimer, the term of this patent is extended or adjusted under 35 U.S.C. 154(b) by 479 days.

(21) Appl. No.: 11/628,858

(22) PCT Filed: Jun. 8, 2005

(86) PCT No.: PCT/EP2005/006264
§ 371 (c)(1),
(2), (4) Date: Jan. 8, 2008

(87) PCT Pub. No.: WO2005/122102
PCT Pub. Date: Dec. 22, 2005

(65) Prior Publication Data

US 2009/0001891 A1 Jan. 1, 2009

(30) Foreign Application Priority Data

Jun. 8, 2004 (GB) ..... 0412737.9
May 6, 2005 (GB) ..... 0509197.0

(51) Int. Cl.
*H05B 37/04* (2006.01)

(52) U.S. Cl. ..... 315/129; 315/149; 315/312

(58) Field of Classification Search ..... 315/129, 315/149, 156–159, 291, 312
See application file for complete search history.

(56) References Cited

U.S. PATENT DOCUMENTS 5,498,931 A * 3/1996 Bedocs ..... 315/158
5,790,019 A 8/1998 Edwin
7,355,349 B2 * 4/2008 Evans ..... 315/149
7,626,507 B2 12/2009 LaCasse
2002/0171379 A1 * 11/2002 Adamson ..... 315/312
2003/0057884 A1 * 3/2003 Dowling et al. ..... 315/291
2003/0079387 A1 * 5/2003 Derose ..... 40/544
2003/0189823 A1 * 10/2003 George et al. ..... 362/84
2004/0105264 A1 * 6/2004 Spero ..... 362/276
2005/0099824 A1 * 5/2005 Dowling et al. ..... 362/572
2005/0141225 A1 * 6/2005 Striebel ..... 362/382
2006/0091827 A1 * 5/2006 Chevalier et al. ..... 315/291

FOREIGN PATENT DOCUMENTS

DE 20 2004 002 248 U1 5/2004
EP 0 323 681 A1 7/1989

OTHER PUBLICATIONS

International Search Report dated Sep. 22, 2005 (three pages).

* cited by examiner

*Primary Examiner* — Douglas W Owens
*Assistant Examiner* — Tung X Le
(74) *Attorney, Agent, or Firm* — Sullivan & Worcester LLP

(57) ABSTRACT

An emergency lighting system comprising light units and sensors, such as heat detectors, smoke detectors and motion detectors, operable to activate the light units. In the preferred embodiment, the light units are operable to adopt a selected one of at least two illuminated stated depending on the state of the sensors. Each illuminated state may involve the display of a symbol, text message or illumination pattern such as an arrow or a warning indicator, and/or may involve the emission of a respective illumination color. The emergency lighting system may be associated with a set of stairs in order to illuminate the stairs when activated.

19 Claims, 7 Drawing Sheets

EMERGENCY LIGHTING

FIELD OF THE INVENTION

The present invention is concerned with emergency lighting, in particular for use in directing the occupants of a building to safety in the event of a fire

BACKGROUND TO THE INVENTION

The largest single cause of death and injury from fire results from fires that occur accidentally. A large percentage of such fires occur in the hours of darkness, thereby greatly increasing the dangers associated with such fires, as a result of reduced visibility, and therefore ability to escape from a dwelling, particularly in the presence of heavy smoke.

In 2002, local authority fire brigades in the United Kingdom attended nearly 1 million fires, of which over 105,000 were building fires, consisting of approximately 65,000 dwelling fires and 40,000 fires in buildings such as commercial premises, schools, etc. The total number of fire deaths was 578, with 443 occurring in dwelling fires. In addition, there were 13,300 non-fatal casualties in dwelling fires. Economic costs are enormous, with direct property losses amounting to 0.2% GDP, and when this is added to consequential losses, costs of emergency services, fire insurance etc., it is estimated that this costs the United Kingdom £6.9 billion a year.

SUMMARY OF THE INVENTION

The present invention therefore provides an emergency lighting system comprising at least one light unit or source; and at least one sensor operable to actuate the at least one light unit or source. When illuminated, the light unit(s) may display a symbol or text message, or may simply provide a source of light.

Preferably, the at least one sensor may comprise a proximity sensor, a smoke detector, a heat sensor, an auditory sensor, a light detector and/or an alarm activation unit.

The system may comprise an override switch operable to override the at least one sensor in order to actuate the at least one light source.

Preferably, the system includes or is connectable to a power supply, for example battery supply or other auxiliary supply, that is independent of the mains supply.

The at least one light source may be shaped and dimensioned for location on or adjacent a step of a set of stairs. The at least one light source may be substantially L shaped and elongate in form, for mounting on an edge of a step. The at least one light source may take the form of a stair rod.

Preferably, the at least one light unit incorporates one or more light elements, advantageously LEDs.

The at least one light source may take the form of a floor tile or may be associated with light switches, doors, doorways, windows, handles, and/or emergency equipment, as is described in more detail hereinafter.

Preferably, the light source includes a plurality of LED's arranged to form a directional indicator, or configurable to form one or more directional indicators or other signs, symbols or indicators.

In preferred embodiments, at least one of the light units or sources are operable to adopt a selected one of at least two illuminated states (in addition to the ON and OFF states) depending on the state of one or more sensors and/or in accordance with instructions received from a data processing unit (shown as a "Smart Box" in FIG. 9). Each illumination state may involve the presentation of a respective illumination pattern (e.g. a symbol such as a directional indicators, warning indicators, stop indicators and/or text) and/or the emission of a respective illumination colour (typically red, green or blue where LEDs are used in the light units). Each light source may be associated with one or more sensors whose output determines which illumination state is adopted. One or more configurable light sources may be associated with one or more locations or objects in the building that are, in turn, associated with one or more sensors such that the light source (s) are caused to adopt one or more illumination states depending on the data received from the associated sensor(s).

This facilitates the provision of a dynamic emergency lighting system whose overall configuration may be changed in response to changing conditions in the surrounding environment.

Other aspects of the invention provide light units, such as tiles or stair rods, as are described hereinafter.

Other advantageous features of the invention are recited in the dependent claims. Further advantageous aspects of the invention will become apparent to those ordinarily skilled in the art upon review of the following description of specific embodiments and with reference to the accompanying drawings.

BRIEF DESCRIPTION OF THE DRAWINGS

Preferred embodiments of the invention will now be described by way of example and with reference to the accompanying drawings, in which.

DETAILED DESCRIPTION OF THE DRAWINGS

Figure 1:
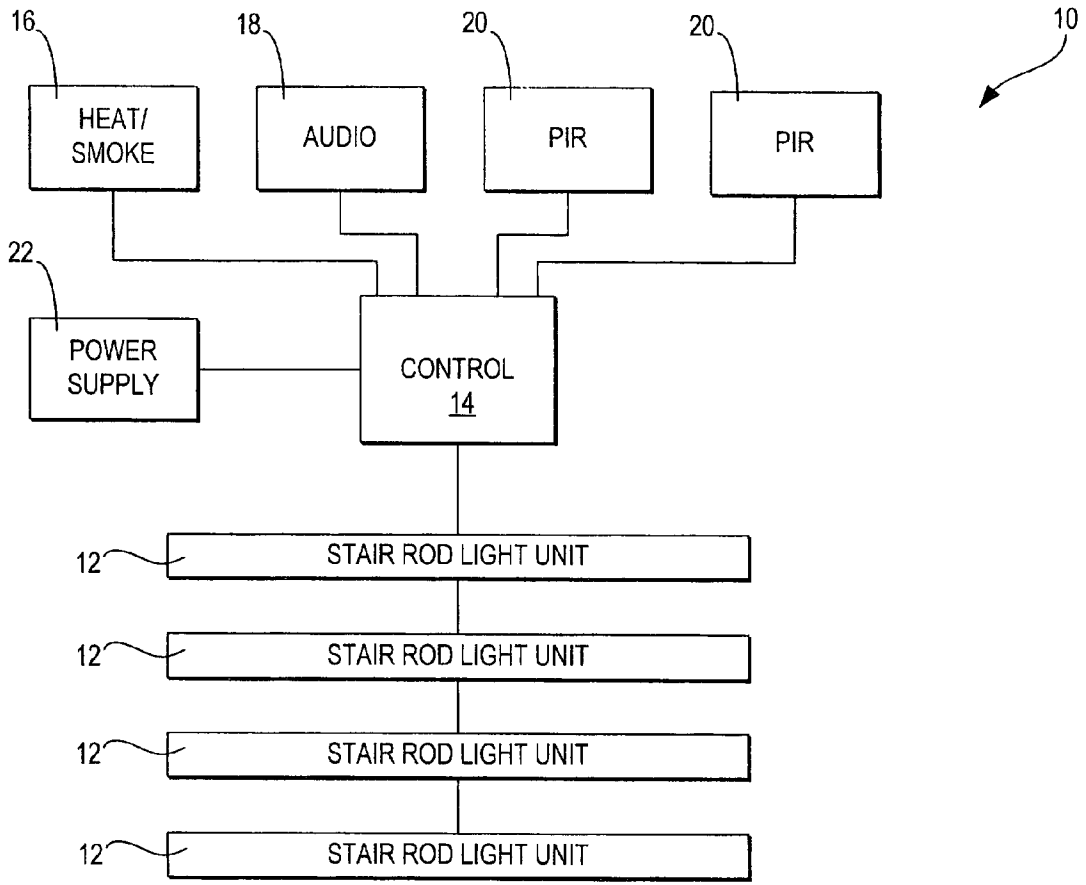
FIG. 1 is a schematic illustration of a first embodiment of an emergency lighting system according to the present invention.
Figure 2:
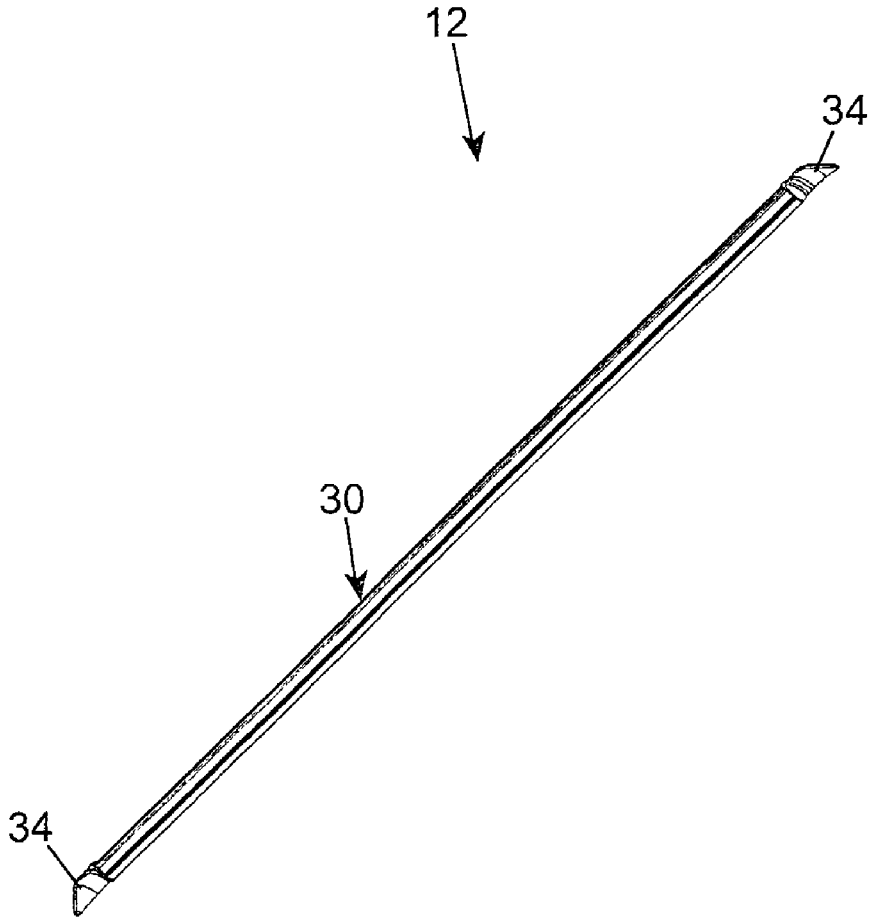
FIG. 2 illustrates a perspective view of a light source in the form of a stair rod, forming part of the system of the invention.
Figure 3:
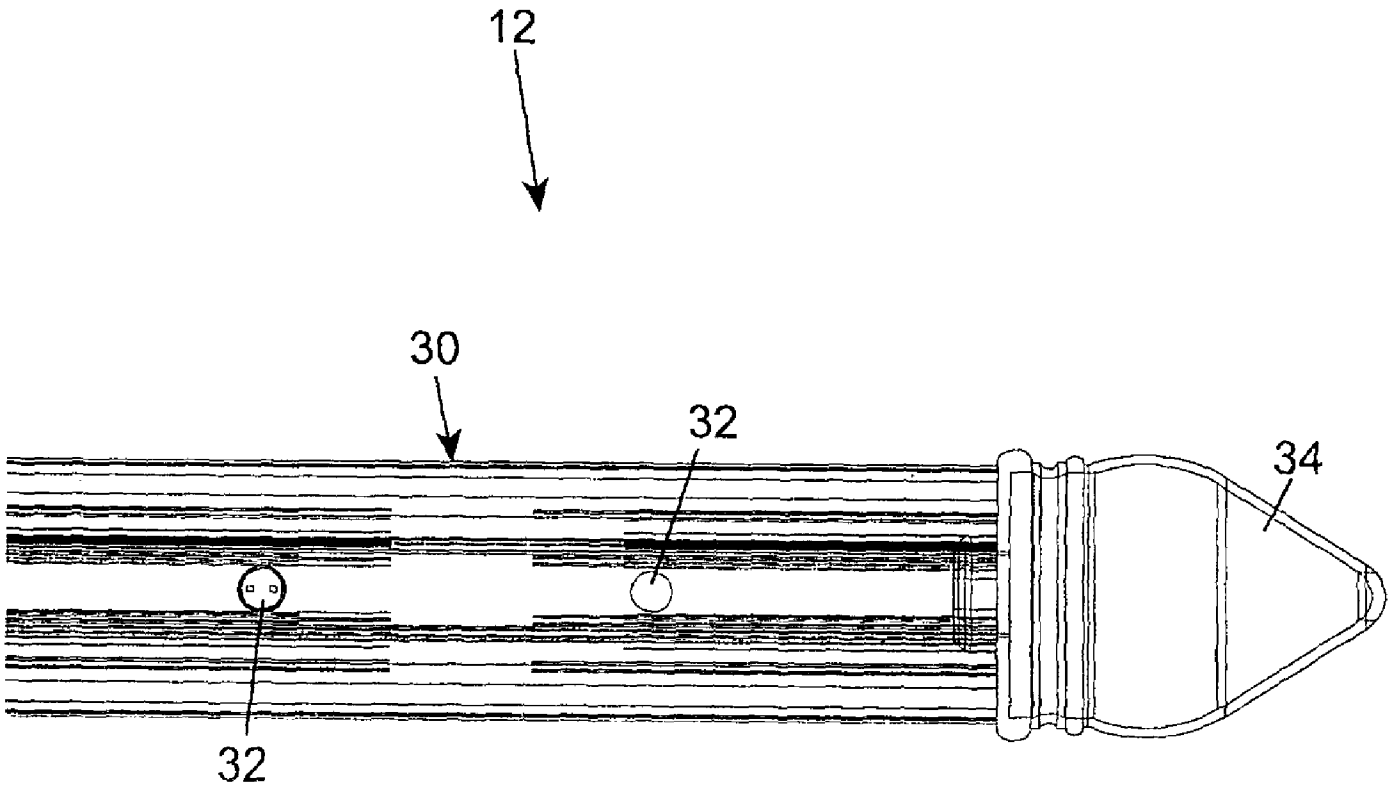
FIG. 3 illustrates an enlarged view of an end of the stair rod of FIG. 2.

Referring now to the accompanying drawings, FIG. 1 shows a first embodiment of an emergency lighting system, generally indicated as 10, for use in directing people from a building, in particular up or down the stairs (not shown) of a building during an emergency situation, in particular a fire. The system 10 includes a plurality of light units or sources 12 that are shaped and dimensioned, as will be described in detail hereinafter, to be fitted to or adjacent a respective step or stair (indicated at 60 in FIG. 9) of a flight of stairs in order to illuminate the stairs, particularly in the presence of heavy smoke, in order to direct people up or down the stairs to safety. The light units 12, which may take a variety of shapes or forms, may be arranged in any configuration that suits the location in which the system 10 is installed.

Figure 9:
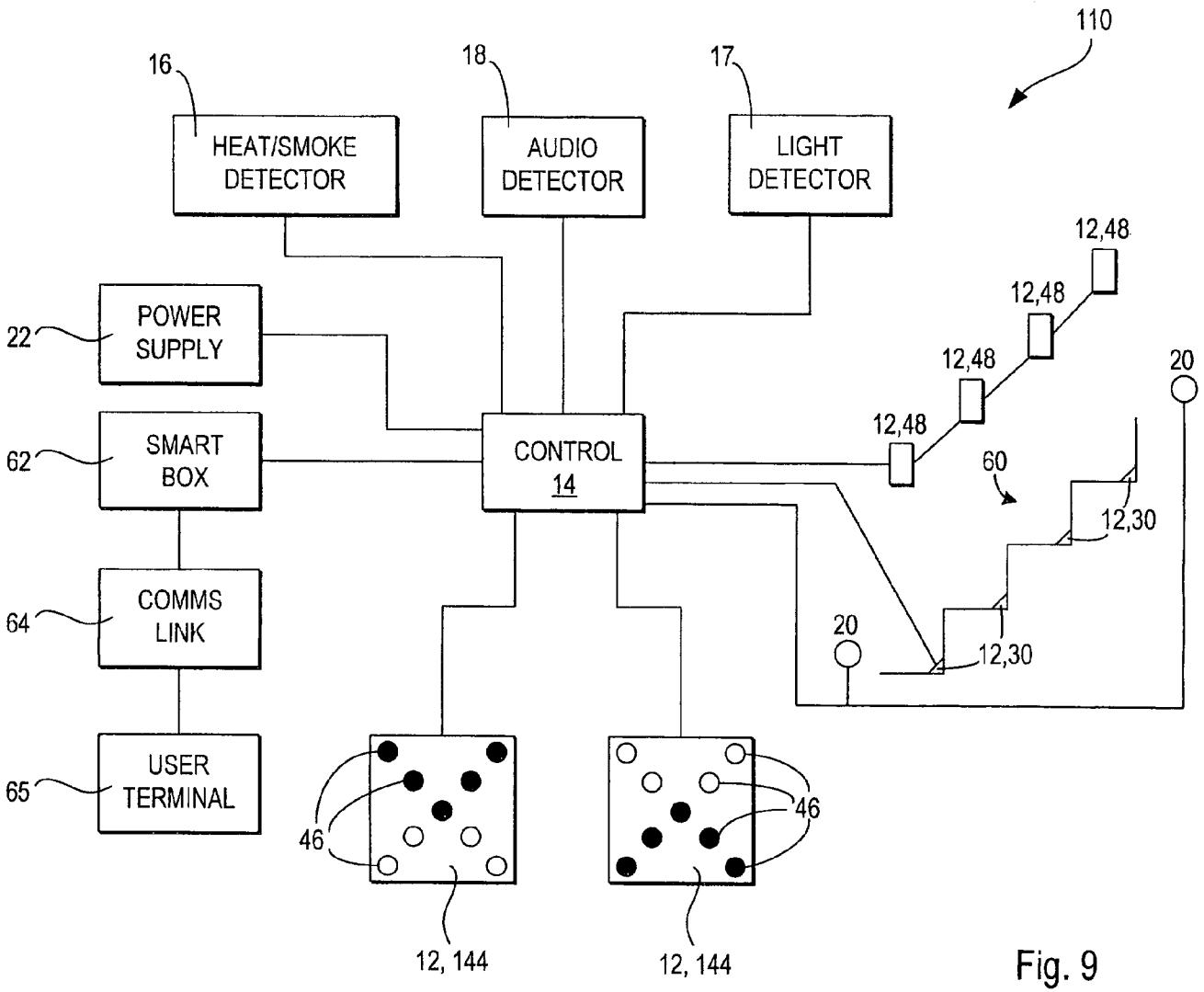
FIG. 9 is a block diagram of a preferred system embodying the invention.

In FIGS. 1 and 9, four light sources 12 are shown (by way of example only), illustrating how the system 10 would be deployed on stairs 60 with four steps, one light source 12 for each step. In alternative embodiments, the light sources need not necessarily be located on or adjacent a stairway, and may be used to illuminate other locations, e.g. a corridor, window, doorway or emergency exit.

The light sources 12 are each connected directly or indirectly to a control unit or box 14, which is operable to operate the light sources 12 in response to a signal received from one or more sensors. For example, a heat and/or smoke sensor 16 may be connected to the control unit 14, which in the presence of heat and/or smoke (above a pre-determined threshold) is activated to send an electrical signal to the control box 14. Upon receipt of the signal from the sensor 16, the control unit 14 sends an activating signal to the light units 12 in order to illuminate the stairs. The light units 12 are typically activatable at least between an ON (i.e. illuminated) state and an OFF (i.e. non-illuminated) state. One or more light units 12 may also be activatable between two or more illumination, or illuminated, states, as is described in more detail hereinafter.

The system 10 may also incorporate an audio sensor 18, again connected to the control box 14, that sends an electrical signal to the control unit 14 upon detection of an audible fire alarm (not shown), such as a siren or the like, in response to which the control unit activates the light units 12 to illuminate the stairs.

Sensors included in the system 10 may also, or alternatively, take the form of alarm activation points (commonly known as "break glass points"), or light detectors 17 (see FIG. 9). In each case, the sensors, when activated, send a signal to the control unit 14 in response to which the control unit 14 causes the light units 12 to be turned on. When light detectors are used, the arrangement is such that the light units 12 are activated when detected light levels fall below a pre-determined threshold.

The system 10 may include one or more proximity or motion sensors 20, for example in the form of passive infrared (PIR) sensors, connected to the control box 14. In the system of FIG. 1, it is preferred that at least one respective proximity sensor 20 is located at the top and bottom of the stairs 60 on which the light sources 12 are located. In use, when the proximity sensors 20 detect the presence of a person in the vicinity of the stairs, a signal is sent to the control unit 14 in response to which the control unit 14 causes the light sources 12 to be illuminated.

The system 10 includes, or is connectable to, a power supply 22, which may be a mains supply, an auxiliary electricity supply, or may be a self-contained power supply such as a battery or the like, in order to ensure the operation of the system 10 during a power cut or similar power loss, which may occur in the presence of fire.

The following examples illustrate the operation of the system 10 in various situations. As a first example, assume a fire breaks out in a residential dwelling during the night, in response to which a fire alarm (not shown) and/or smoke alarm is activated. The audio sensor 18 of the system 10 receives an auditory signal generated by the fire alarm and so sends a signal to the control unit 14. The smoke/heat detector 16 may also send a signal to the control unit 14. As a result, the control unit 14 activates the light sources 12 such that they adopt an illuminated state. The illuminated light sources 12 assist the occupants of the building in locating and negotiating the stairs. As a second example, should a person attempt to negotiate the stairs at night without turning any lights on, a proximity sensor 20 is activated as the person approaches the stairs, thereby activating each of the light sources 12.

The system 10 may also be provided with an override switch (not shown), which is operable to override each of the sensors 16, 17, 18, 20, in order to turn on the light sources 12. The light sources 12 may therefore be left on as a decorative feature. Such an override switch (not shown) should preferably not be able to override the sensors 16, 17, 18, 20 to turn off the light sources 12.

The various sensors 16, 17 18, 20 may take any suitable conventional form. For example the proximity sensors 20 may be of the passive infrared (PIR) type, or could be ultrasound sensors. The heat/smoke sensor 16 may again be of any suitable form, or could be split into two individual sensors (not shown), namely a heat sensor (not shown) and a separate smoke sensor (not shown). The systems 10, 110 may include any suitable type and number of sensor and is not limited to the particular types and numbers shown in FIGS. 1 and 9.

Referring now to FIGS. 2 to 8, the system 10 may incorporate a plurality of the light sources 12 in one or more forms, to suit particular locations or decorative requirements, or to fulfil a particular technical effect. Thus, referring to FIG. 2, one or more light source or unit 12 may be take the form of a stair rod 30 for location across the width of each step (shown in FIG. 9), in the corner between the respective riser and tread. The stair rod 30 may be formed from any suitable material, for example high impact plastic, or brass if a more decorative appearance is desired. In a preferred embodiment, the stair rod 30 includes a plurality of LEDs 32 arranged in a row or an array along the length of the stair rod 30, the LEDs 32 being illuminated upon activation of the system 10 as described above. The LED's could be replaced with any other suitable light element, such as a conventional bulb or neon strip, although LED's are preferred in view of the ability of the light generated therefrom to penetrate heavy smoke. The stair rod 30 may also be provided with decorative ends 34, although these are of course an optional feature. Advantageously, one or more windows are provided in the stair rod 30, the LEDs, or other light element, being located behind the window(s) such that light from the LED's 32 may be projected therefrom.

Figure 4:
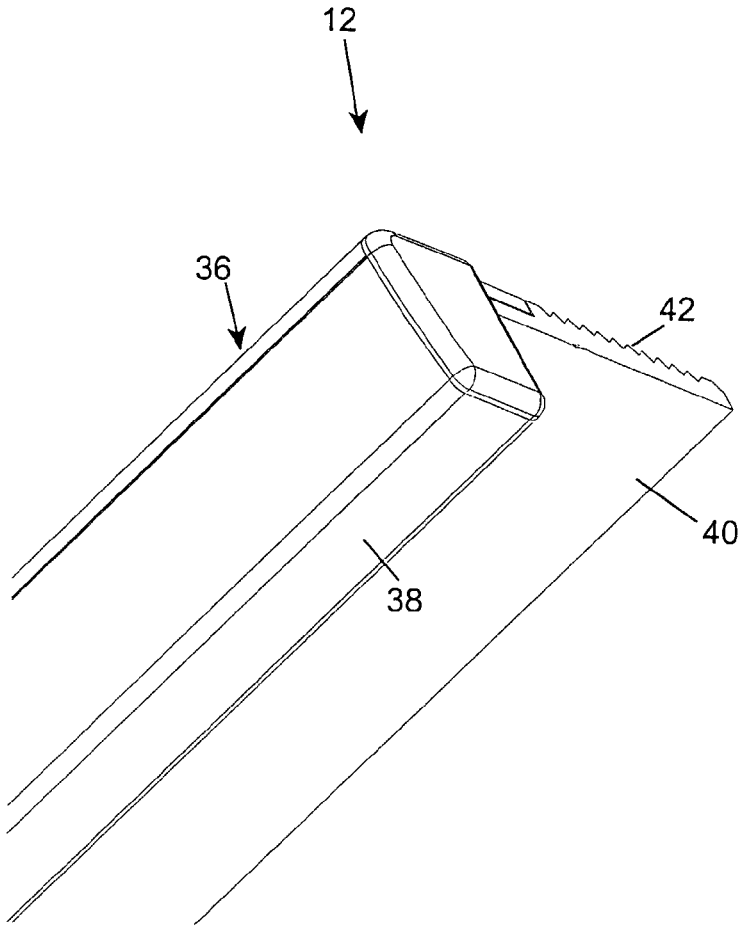
FIG. 4 illustrates an end view of another form of light source, in the form of a tread unit for location along the edge of a stair step.

As shown in FIG. 4, one or more light units 12 may alternatively or additionally be provided as a tread unit 36 for location about the edge of a respective step, again to illuminate the stairs upon activation of the system 10. The tread unit 36 may comprises a lip 38 which is seated against, in use, the riser of the respective step, and a tread portion 40 which is seated, in use, flat against the tread of the respective step. The tread unit 36 may be secured to the step by any suitable means, for example, mechanical fasteners such as screws or the like, or by means of an adhesive. The tread unit 36 preferably includes a row or array of LED's (not shown), or other light elements. Conveniently, the LEDs, or other light elements, are carried by, and typically housed within, the lip 38, and may be arranged to shine outwardly therefrom either generally perpendicular to, or parallel with, the tread of the respective step. To this end, the lip 38, or at least a surface thereof, includes a window behind which the light elements are located. The tread unit 36 is preferably provided with a serrated section 42 in order to increase grip when ascending or descending the stairs. The tread unit 36 may again be of any suitable material, preferably high impact plastic or the like.

Figure 5:
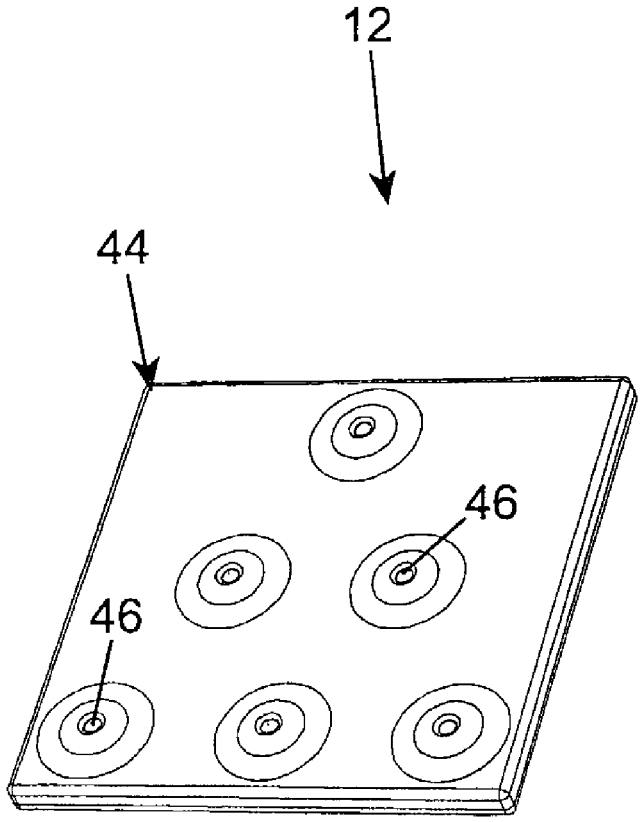
FIG. 5 illustrates a perspective view of a floor tile which may be used as a light source in the lighting system of the present invention.
Figure 6:
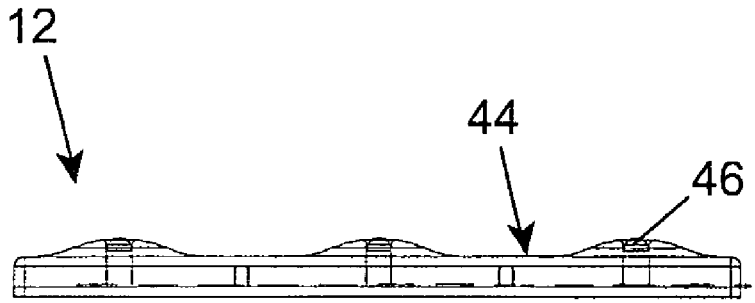
FIG. 6 illustrates a side elevation of the floor tile of FIG. 5.

Referring now to FIGS. 5 and 6, one or more light units 12 may be provided in the form of a tile 44 for location on a floor or wall, again to provide illumination to particular areas. The tile 44 incorporates a plurality of light elements, preferably LEDs 46. Advantageously, the LEDs are arranged to form an arrow or other directional indictor. Thus, the tile 44 may be arranged to point in a particular direction, for example towards an exit. Alternatively, one or more respective tiles 44 may be positioned at the top and bottom of the stairs, pointing up or down the stairs as appropriate in order to direct people toward an exit. For example, on stairs leading from, say, the first floor to the ground floor, the arrows would point down the stairs, while on a stairs leading, for example, from a basement to the ground floor, the arrows would point up the stairs. The tiles 44 could also be positioned at intervals along a wall or the like, preferably adjacent the floor, in order to provide low level illumination and, in preferred embodiments, a directional indicator.

Figure 7:
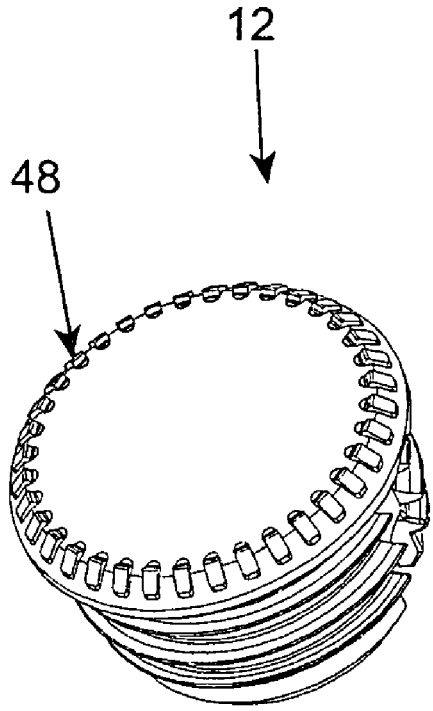
FIG. 7 illustrates a perspective view of a downlighter which may be used as a light source.
Figure 8:
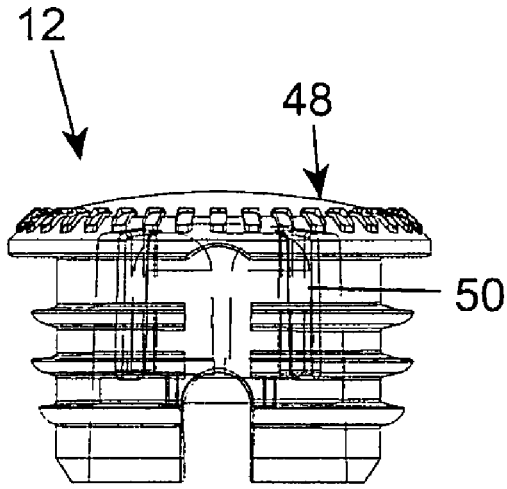
FIG. 8 illustrates a sectioned side elevation of the downlighter of FIG. 7.

Referring now to FIGS. 7 and 8, one or more light unit 12 may take the form of one or more spotlights or down lighters 48 that are located, in use, at the underside of a stair handrail (not shown), or other handrail, to illuminate the stairs upon activation of the system 10 as described above. The preferred down lighter 48 incorporates a plurality of LED's 50, although a conventional bulb or neon light could alternatively be used.

The system 10 provides an effective means of directing people up or down stairs, or alternatively along a corridor or the like, during an emergency situation, in order to safely exit a building.

FIG. 9 shows a block diagram of a preferred system 110, which is generally similar to the system 10 described above and in respect of which like numerals are used to indicate like parts. FIG. 9 also shows, for illustration purposes, a flight of stairs 60, including stair rod light units 30 of the type described with reference to FIGS. 2 and 3, and downlighters 48 on the underside of the banister (not shown). A preferred embodiment of a tile 144 is also shown and is described in more detail below. The system 110 may also include a data processing unit 62 (identified as a "Smart Box" in FIG. 9) which may be connectable to a remote terminal 65, e.g. a PC or other workstation (not shown), by means of a modem 64 or other communications link. Alternatively, the data processing unit 62 may be located remotely of the rest of the system 10 and may communicate with the control unit 14 by any suitable communications link.

The tile 144 includes a plurality of light elements, conveniently LEDs 46, which may be incorporated therein as described for the tile 44 of FIGS. 5 and 6. Advantageously, the arrangement is such that the LEDs 46 (or other light elements) may be collectively activated by the control unit 14 to adopt at least two illumination, or illuminated, states in order to provide more than one illumination pattern (each pattern being created by, for example, a respective set of LEDs 46 being activated while the other LEDs 46 remain deactivated).

In one embodiment, the LEDs 46 are arranged in an "X" pattern, as shown in FIG. 9. By way of example, FIG. 9 shows two tiles 144 each providing a respective illumination pattern determined by which LEDs 46 are activated (activated LEDs are shown as filled circles in FIG. 9). In the left (as viewed in FIG. 9) tile 144, a plurality of LEDs 46 are activated to provide a V-shaped illuminated pattern that points downwardly (as viewed in FIG. 9). In the right (as viewed in FIG. 9) tile 144 a plurality of LEDs 46 are activated to provide a V-shaped illuminated pattern that points upwardly (as viewed in FIG. 9). It will be apparent that the LEDs 46 could alternatively be activated to provide a V-shaped illumination pattern that points left or right (as viewed in FIG. 9). Each illumination pattern may therefore serve as a directional indicator, or arrow. In an alternative configuration (not illustrated), the LEDs 46 may be activated to create an X-shaped illumination pattern. This may indicate that a user should not pass beyond the tile 144, i.e. a stop indicator.

In preferred embodiments, at least some of the LEDs are capable of emitting more than one colour of light (e.g. conventional RGB ultrabright LEDs), the control unit 14 being arranged to select different colours for different illumination patterns. For example, the V-shaped directional indicators may be formed by green light while the X-shaped pattern may be formed by red light (in order to emphasise danger). In general, the tile 144 comprises a plurality of light elements arranged in a two dimensional array, or an X-shape, or other pattern, such that more than one illumination pattern can be created under the control of the control unit 14 by appropriate setting of the respective state of the LEDs. Preferably, the possible illumination patterns include one or more directional indicators and/or a stop indicator.

In the preferred embodiment, the control unit 14 may determine how to configure the LEDs 46 of a given tile 144 depending on the signal(s) it receives from one or more of its sensor inputs (e.g. smoke detector, proximity detector, light detector and/or heat sensor). For example, should the control unit 14 determine, from one or more sensor input, that, say, a particular room or corridor is a danger area (e.g. by excessive heat or smoke being detected), then it may cause one or more associated tiles 144 (e.g. tiles that are located outside a door to the room, or at the end of the corridor) to be configured to warn people against entering the dangerous area and/or directing them away from the dangerous area.

In embodiments where the data processing unit 62, or smart box, is provided, the unit 62 may instruct the control unit 14 as to how the tiles 44 may be configured. To this end, the control unit 14 may provide to the data processing unit 62 data representing the input signals received from the sensors. The data processing unit 62, which typically comprises a suitably programmed microprocessor or microcontroller, evaluates the data and instructs the control unit 14 accordingly. Alternatively, or in addition, the data processing unit 62 may display the sensor data to a user (not shown) at the remote workstation or terminal 65 and the user may provide the data processing unit with instructions as to how the tiles 144 (and/or other visual aids) should be activated.

More generally, the data processing unit 62 may instruct the control unit as to how to configure or activate one or more of the light elements, or units, of the system in response to data representing the input signals received from the sensors and/or under the control of a remote user.

The provision of light units comprising multiple, configurable light elements, e.g. LEDs, as described above in relation to tiles 144, is not limited to use with tiles and may, for example, be used with wall panels (not shown) or any other unit that may be incorporated into, or mounted on, the fabric of a building.

It will be understood from the foregoing that systems embodying the invention may include one or more light sources or units (e.g. tiles 44, 144 or stair rod 36) comprised of one or more light elements (e.g. LEDs 32, 46). In cases where the light unit has more than one light element, the light elements may be each be configurable to provide more than one illuminated state (e.g. more than one different colour) and/or collectively configurable to provide more than one illumination pattern (e.g. one or more different directional indictors and/or stop indicators and/or other warning indicators), or be activatable to provide a single fixed illumination pattern. The light units are preferably provided at or adjacent floor level but may also be located above floor level, for example up to approximately 1.5 meters from floor level.

In one embodiment, a light source may be incorporated into or associated with, an otherwise generally conventional light switch fitting of the type that are commonly located adjacent doorways. This may be achieved in any convenient manner. For example, one or more light elements, e.g. LEDs, may be embedded in the light switch fitting or located adjacent the light switch fitting. Alternatively, all or part of the light switch fitting may be formed from a transparent or translucent material, typically plastics, behind which one or more light elements are located.

Similarly, light units may be incorporated into, mounted on, or otherwise associated with, doors, door handles, doorways or exit points, e.g. windows, in a variety of ways. For example, one or more light units or elements may be embedded in, or mounted on, a door, a door handle, door frame or window frame or located adjacent a door, door handle, door frame or window frame, especially those that are associated with exit routes. For example, all or part of the door, door handle, door frame or window frame may be formed from a transparent or translucent material, typically plastics, behind which one or more light elements are located. Optionally, the light sources may be arranged to provide suitable text or emergency signage, e.g. WAY OUT or EMERGENCY EXIT. This may be achieved in any suitable manner, for example by using the light source to illuminate a sign or by arranging light elements to spell the desired word(s) or create a desired symbol. Such light sources may also be provided on the push bar of emergency doors and or be associated with other objects such as emergency equipment (e.g. fire extinguishers, hose reels, fire axes, alarm activation points etc.) in order to mark same and/or to provide any required information (e.g. FOAM or WATER). The illumination of light sources may, for example, be constant or pulsed Advantageously, some or all the light sources described above may be operable by the control unit 14 in the manner described above for the stair rods 36, tiles 44, 144 and downlighters 48. Hence, the overall configuration of the light sources (including which light sources are activated and which are not) is set by the control unit 14 in response to one or more sensor inputs and/or in accordance with instructions received from the data processing unit 62. Associating emergency lighting with light switch fittings, doorways and the like helps to locate exit points in the event of an emergency.

In preferred embodiments, at least one of the light units or sources 12 (including any of the light sources or units described above) are operable, by the control unit 14, to adopt a selected one of at least two illumination, or illuminated, states (in addition to the ON and OFF states) depending on the sensor input(s) received by the control unit 14 and/or in accordance with instructions received from the data processing unit 62. Each illumination state may involve the presentation of a respective illumination pattern (e.g. directional indicators, warning indicators, stop indictors and/or text) and/or the emission of a respective illumination colour (typically red, green or blue where LEDs are used in the light units). Each light unit may be associated with one or more sensors whose output determines which illumination state is adopted.

For example, one or more light units associated with a door or doorway (e.g. the tile type, light switch type, door frame or door handle type described above) may be associated with a sensor (e.g. a heat detector or smoke detector) in a room or corridor beyond the door. Should the sensor indicate that excessive heat or smoke is detected in the room or corridor, then the associated light unit(s) may be caused to adopt an illumination state indicating that the room should not be entered. In one embodiment, this may be achieved by changing the illumination colour of the light unit. For example, the light unit may project a first colour, say green, when it is safe to pass through the door, and a second colour, say red, when it is deemed not to be safe to pass through the door. In cases where the light unit(s) may adopt different illumination patterns, they may be caused to present an illumination pattern that warns against passing through the door and/or directs people away from the door. For example, should one or more tiles 144 be located near the door, they may be configured to direct people away from the door.

Light units may also be activated or configured depending on data received from proximity detectors or motion sensors. For example, in the case where, say, a flight of stairs, length of corridor or other location, is associated with one or more proximity or movement sensors, the information received from the sensor(s) may be used to determine in which direction a person is moving and this information may be used to determine how to configure the associated light unit(s). For example, if the environmental conditions are such that movement in one direction is towards an area of danger, then the light units may adopt an appropriate illumination state (e.g. turn red), while the same light units may adopt a different illumination state (e.g. turn green) if it is determined that the person is travelling in the other direction, i.e. away from the danger area.

More generally, one or more configurable light units may be associated with one or more locations or objects in the building that are, in turn, associated with one or more sensors such that the light unit(s) are caused to adopt one or more illumination states depending on the data received from the associated sensor(s). This facilitates the provision of a dynamic emergency lighting system whose overall configuration may be changed in response to changing conditions in the surrounding environment.

The overall configuration of the system 10, 110 or of individual light units 12 may be performed automatically by the control unit 14, and/or automatically by the data processing unit 62 under suitable program control, and/or by a user receiving data from and sending data to the data processing unit 62. The data processing unit 62 may be located with the control unit 14 (which typically is located in the building itself) or may be remotely located in which case it communicates with the control unit 14 by any suitable communications link. Hence, in response to the environmental conditions as detected by the sensors, the light units may be set or configured to provide emergency lighting in appropriate locations, to mark appropriate escape routes or objects and/or to mark thresholds beyond which it is unsafe to pass.

Optionally, systems embodying the invention may include, or be co-operable with, a personnel monitoring system. Personnel monitoring systems are well known and, amongst other things, can monitor, e.g. count, the number of people in a building, on each floor of a building and/or in each room of a building. Typically, this is achieved by providing each person with a detectable tag (e.g. a magnetic or electronic tag) and providing tag detectors at various locations throughout the building. The tag detectors communicate with a control unit which, in the present context, may be in communication with, or incorporated into, the data processing unit 62. The data provided by the personnel monitoring system may be used to determine how the overall system 10, 110 or light units 12 are configured. Optionally, in buildings, such as hotels, where rooms have an electronic card access system, the access system may be adapted to send data to the data processing unit 62 in order to monitor whether or not the room is empty. It will be understood that, where features described above are not dependent on one another, they may be provided independently of other features and may each be considered as separate aspects of the invention.

The present invention is not limited to the embodiments described herein, which may be amended or modified without departing from the scope of the present invention.

The invention claimed is:

1. An emergency lighting system comprising at least one light unit and at least one sensor operable to activate the at least one light unit, characterized in that at least one of the light units is operable to adopt a selected one of at least two illuminated states depending on the state of at least one of said at least one sensor and in accordance with instructions from a data processing unit comprising part of said system, wherein each illuminated state provides discrete and different instructions and information to a viewer and wherein at least one light unit includes a plurality of light elements arranged in a pattern that enables said light elements, when illuminated, to provide a directional indicator.

2. An emergency lighting system as claimed in claim 1, wherein at least two of said illuminated states involve the display of a respective symbol, text message or illumination pattern.

3. An emergency lighting system as claimed in claim 2, wherein said symbol or illumination pattern comprises a directional indictor or a warning indicator.

4. An emergency lighting system as claim 1, wherein at least two of said illuminated states involve the emission of a respective illumination color.

5. An emergency lighting system as claimed in claim 1, wherein said at least one light unit is associated with one or more sensors whose output determines which illumination state is adopted.

6. An emergency lighting system as claimed in claim 1, wherein at least one light unit is associated with at least one location or object in a building, said at least one location or object being associated with at least one sensor such that the at least one light unit is operated depending on the state of the associated at least one sensor.

7. An emergency lighting system as claimed in claim 1, wherein the at least one sensor comprises at least one proximity sensor and/or motion detector and/or smoke detector and/or heat sensor and/or audio sensor and/or light detector and/or alarm activation unit.

8. An emergency lighting system as claimed in claim 1, wherein said at least one sensor includes a heat detector and/or smoke detector arranged to detect heat and/or smoke in a first location on a first side of a doorway, said doorway leading to a second location on the opposite side of the doorway, and wherein at least one of said at least one light unit is associated with said second location and is operable depending on the state of the heat detector and/or smoke detector.

9. An emergency lighting system as claimed in claim 1, wherein at least one light unit is associated with a set of stairs in order to illuminate the stairs when activated.

10. An emergency lighting system as claimed in claim 9, wherein said at least one light unit includes at least one stair rod incorporating at least one light element.

11. An emergency lighting system as claimed in claim 9, wherein said at least one light unit includes at least one tread unit adapted to fit over the leading edge of a stair, the at least one tread unit incorporating at least one light element.

12. An emergency lighting system as claimed in claim 9, wherein said stairs are associated with a hand rail, said at least one light unit including at least one light unit located at the underside of the hand rail and arranged to illuminate one or more stairs when activated.

13. An emergency lighting system as claimed in claim 9, wherein a respective sensor in the form of a proximity or motion detector is provided at the top and/or bottom of the stairs.

14. An emergency lighting system as claimed in claim 1, wherein said light elements are arranged in a pattern that enables said light elements, when illuminated, to form more than one symbol and/or more than one text message by selective illumination of said light elements.

15. An emergency lighting system as claimed in claim 1, wherein at least one light unit comprises a tile.

16. An emergency lighting system as claimed in claim 1 wherein at least one light unit is associated with a light switches and/or a door and/or a doorway and/or a window and/or a door handle and/or emergency equipment.

17. An emergency lighting system as claimed in claim 1, wherein said data processing unit receives at least one input signal indicating the state of at least one sensor and determines how to activate at least one light unit depending on said at least one input signal.

18. An emergency lighting system as claimed in claim 1, wherein said data processing unit is arranged to receive instructions from a user and to determine how to activate at least one light unit depending on said user instructions.

19. An emergency lighting system as claimed in claim 1, wherein said data processing unit is arranged to provide data to a user terminal comprising a display unit, said data indicating the state of said at least one sensor and/or said at least one light unit.

* * * * *